US010933508B2

(12) United States Patent
Gasdaska et al.

(10) Patent No.: US 10,933,508 B2
(45) Date of Patent: Mar. 2, 2021

(54) BONDED ABRASIVE ARTICLE INCLUDING A COATING

(71) Applicants: SAINT-GOBAIN ABRASIVES, INC., Worcester, MA (US); SAINT-GOBAIN ABRASIFS, Conflans-Sainte-Honorine (FR)

(72) Inventors: Charles J. Gasdaska, Shrewsbury, MA (US); Alexandre Temperelli, Boston, MA (US); Kenneth Dubovick, Rutland, MA (US); Rachana Upadhyay, Shrewsbury, MA (US); William H. Lane, Princeton, MA (US); Robin M. Bright, Charlton, MA (US)

(73) Assignee: SAINT-GOBAIN ABRASIVES, INC./SAINT-GOBAIN ABRASIFS, Worcester, MA (US)

( * ) Notice: Subject to any disclaimer, the term of this patent is extended or adjusted under 35 U.S.C. 154(b) by 28 days.

(21) Appl. No.: 16/370,284

(22) Filed: Mar. 29, 2019

(65) Prior Publication Data

US 2019/0299365 A1 Oct. 3, 2019

Related U.S. Application Data

(60) Provisional application No. 62/650,876, filed on Mar. 30, 2018.

(51) Int. Cl.

| | |
|---|---|
| ***B24D 5/02*** | (2006.01) |
| ***B24D 18/00*** | (2006.01) |
| *B05D 1/00* | (2006.01) |

(52) U.S. Cl.
CPC ..... *B24D 5/02* (2013.01); *B24D 18/0072* (2013.01); *B05D 1/60* (2013.01)

(58) Field of Classification Search
CPC ..... B24D 5/02; B24D 18/0072; B05D 1/60
See application file for complete search history.

(56) References Cited

U.S. PATENT DOCUMENTS 4,960,050 A 10/1990 Hatch
5,049,164 A 9/1991 Horton
(Continued)

FOREIGN PATENT DOCUMENTS

EP 1075354 B1 12/2004
KR 1020160014977 A 2/2016
(Continued)

OTHER PUBLICATIONS

International Search Report dated Aug. 14, 2019, with regard to International Application No. PCT/US2019/024963.

*Primary Examiner* — Pegah Parvini
(74) *Attorney, Agent, or Firm* — Abel Schillinger, LLP; Joseph P. Sullivan

(57) ABSTRACT

A bonded abrasive article can include a body including a bond material, abrasive particles contained within the bond material, and pores contained within the body. At least a portion of the pores of the body can include a coating. In one aspect, the coating can be a poly(p-xylylene) polymer applied via vapor deposition. The coated abrasive body can maintain a high permeability and pore volume after coating, and the coating can provide an increase in flexural strength and corrosion resistance to the abrasive article, thereby greatly enhancing its life time.

33 Claims, 11 Drawing Sheets

(56) References Cited

U.S. PATENT DOCUMENTS

| | | | | |
|---|---|---|---|---|
| 5,154,978 | A | 10/1992 | Nakayama | |
| 5,534,068 | A | 7/1996 | Beach | |
| 5,707,409 | A | 1/1998 | Martin | |
| 5,849,962 | A | 12/1998 | Dolbier | |
| 6,030,381 | A | 2/2000 | Jones | |
| 6,528,153 | B1 | 3/2003 | Benzing | |
| 8,721,395 | B2 | 5/2014 | Wu | |
| 2004/0235406 | A1* | 11/2004 | Duescher | B24D 11/001 451/527 |
| 2007/0184654 | A1 | 8/2007 | Akram | |
| 2010/0047467 | A1 | 2/2010 | Nesbitt | |
| 2010/0330886 | A1* | 12/2010 | Wu | B24B 53/12 451/56 |
| 2012/0122377 | A1 | 5/2012 | Wu | |
| 2012/0148825 | A1* | 6/2012 | Grosso | C04B 41/52 428/305.5 |
| 2013/0216599 | A1 | 8/2013 | Kumar | |
| 2015/0001700 | A1* | 1/2015 | Hartung | H01L 23/24 257/698 |
| 2017/0008153 | A1 | 1/2017 | Sivasubramanian | |
| 2017/0037509 | A1* | 2/2017 | Faguet | B05D 1/60 |

FOREIGN PATENT DOCUMENTS

| | | | |
|---|---|---|---|
| KR | 101690053 | B1 | 12/2016 |
| WO | 9956913 | A | 11/1999 |

* cited by examiner

Parylene N

Parylene C

Parylene D

Parylene HT

BONDED ABRASIVE ARTICLE INCLUDING A COATING

CROSS-REFERENCE TO RELATED APPLICATION(S)

The present application claims priority under 35 U.S.C. § 119(e) to U.S. Provisional Patent Application No. 62/650,876, filed Mar. 30, 2018, entitled "BONDED ABRASIVE ARTICLE INCLUDING A COATING," naming as inventors Charles J. GASDASKA et al., which application is assigned to the current assignee hereof and is incorporated by reference herein in its entirety.

BACKGROUND

Field of the Disclosure

The following is directed to an abrasive article, and particularly, to a bonded abrasive article including a coating.

Description of the Related Art

Bonded abrasive articles, such as abrasive wheels, can be used for cutting, grinding, or shaping various materials. The industry continues to demand improved bonded abrasive articles having a low wear, high edge stability and extended life time.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
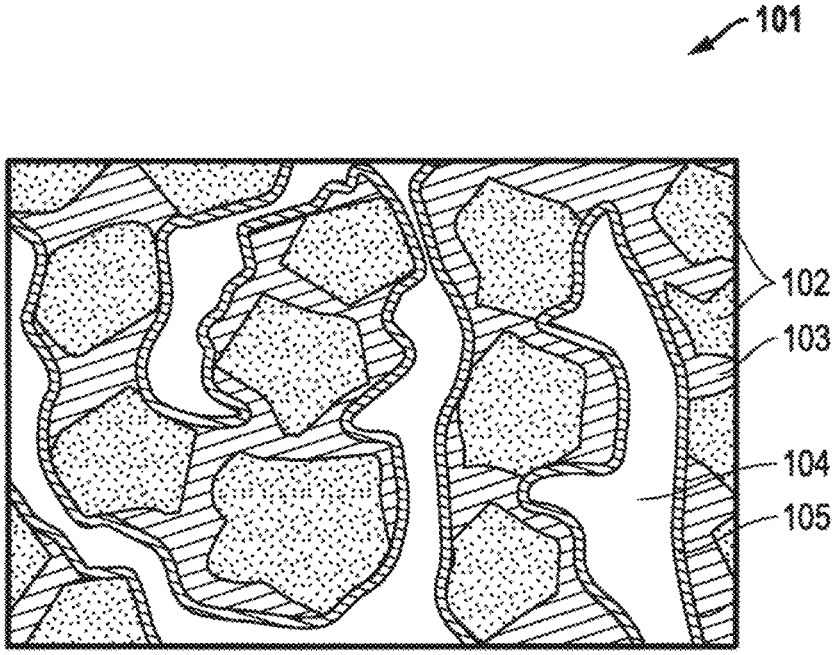
FIG. 1 includes an illustration of a cross section of a body of an abrasive article according to an embodiment.

The following description in combination with the figures is provided to assist in understanding the teachings provided herein. The following disclosure will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

Embodiments disclosed herein are directed to an abrasive article including a body including a bond material and abrasive particles contained within the bond material. The body can further contain pores and a coating. The coating can include a polymeric material and can cover at least a portion of the pores. The coating may provide the advantage of increasing the strength of the bond material and protecting the bond material from corrosion and deterioration when exposed to coolant fluids, specifically water-based coolants.

The bonded abrasive article described in embodiments herein can be suitable for various grinding operations including, for example, for finishing of hardened steel parts, such as cam and crank shafts, finishing of hydraulic components used in internal combustion engines, bearings, fuel injector components and preparation of carbide cutting tools.

The body can have a plurality of interconnected pores formed by the abrasive particles and the bond material. FIG. 1 illustrates a body (101) of an abrasive article according to an embodiment of the present disclosure, including abrasive particles (102) held together with a bond material (103), wherein the voids between the abrasive particles and the bond material define pores (104) within the body. The body (101) can further contain a coating (105) which can cover at least a portion of the exterior surface of the body. As used herein, the term "exterior surface of the body" relates to the complete surface structure of the body, including the surface of the voids (pores) formed by the bond material and the abrasive particles. The applied coating (105) may be suitable to improve the performance of the bonded abrasive, including, but not limited to, providing suitable protection of the bond material (103) from damaging influence of a coolant.

The present disclosure further relates to a method of making the bonded abrasive article. In one embodiment, a bonded abrasive comprising a body can be provided and may be coated by conducting a vapor deposition process under vacuum.

Unlike traditional infiltration processes, which seek to close the porosity within the body via an infiltrant, the bonded abrasive articles herein can maintain a certain permeability with the coating, which may improve the performance of the bonded abrasive. In one embodiment, the body of the present disclosure can have a permeability of at least 1000 mD, measured by mercury intrusion porosimetry according to ASTM D4404-10, such as at least 100 mD, or at least 200 mD, or at least 400 mD, or at least 600 mD, or at least 800 mD, or at least 1000 mD, or at least 1200 mD, or at least 1400 mD, or at least 1600 mD, or at least 1800 mD, or at least 2000 mD, or at least 2200 mD, or at least 2400 mD, or at least 2600 mD, or at least 2800 mD, or at least 3000 mD, or at least 3200 mD, or at least 3400 mD, or at least 3800 mD, or at least 4200 mD, or at least 4600 mD, or at least 5000 mD, or at least 5400 mD, or at least 5800 mD, or at least 6200 mD, or at least 6600 mD, or at least 7000 mD, or at least 7400 mD, or at least 7800 mD, or at least 8200 mD, or at least 9200 mD, or at least 9600 mD, or at least 9800 mD. In another embodiment, the permeability of the body may be not greater than not greater than 10,000 mD, or not greater than 9800 mD, or not greater than 9600 mD, or not greater than 9200 mD, or not greater than 8800 mD, or not greater than 8400 mD, or not greater than 8000 mD, or not greater than 7600 mD, or not greater than 7200 mD, or not greater than 6800 mD, or not greater than 6400 mD, or not greater than 6000 mD, or not greater than 5600 mD, or not greater than 5200 mD, or not greater than 4800 mD, or not greater than 4400 mD, or not greater than 4000 mD, or not greater than 3600 mD, or not greater than 3200 mD, or not greater than 2800 mD, or not greater than 2400 mD, or not greater than 2000 mD, or not greater than 2600 mD, or not greater than 2200 mD, or not greater than 1800 mD, or not greater than 1600 mD, or not greater than 1200 mD. The permeability of the body can be a value between any of the minimum and maximum values noted above, such as within a range including at least 1000 mD to not greater than 10000 mD, or at least 1200 mD to not greater than 7000 mD, or at least 1500 mD to not greater than 5000 mD. In a particular embodiment, the permeability can be at least 3000 mD to not greater than 5000 mD.

In yet another embodiment, the body of the abrasive article of the present disclosure can have a total porosity of at least 1 vol % for the total volume of the body, or at least 2 vol %, or at least 5 vol %, or at least 8 vol %, or at least 10 vol %, or at least 15 vol %, or at least 20 vol %, or at least 25 vol %, or at least 30 vol %, or at least 35 vol %, or at least 40 vol %, or at least 45 vol %, or at least 50 vol %, or at least 55 vol %, or at least 60 vol %, or at least 65 vol %, or at least 70 vol %, or at least 75 vol %. In a further embodiment, the total porosity of the body may be not greater than 90 vol % for the total volume of the body, or not greater than 85 vol %, or not greater than 80 vol %, or not greater than 75 vol %, or not greater than 70 vol %, or not greater than 65 vol %, or not greater than 60 vol %, or not greater than 55 vol %, or not greater than 50 vol %, or not greater than 45 vol %, or not greater than 40 vol %, or not greater than 35 vol %, or not greater than 30 vol %, or not greater than 25 vol %, or not greater than 20 vol %, or not greater than 15 vol %, or not greater than 10 vol %, or not greater than 5 vol %, or not greater than 3 vol %. The total porosity of the body can be a value between any of the minimum and maximum values noted above, such as within a range including at least 1 vol % to not greater than 85 vol %, or at least 5 vol % to not greater than 70 vol %, or at least 15 vol % to not greater than 45 vol %, or at least 20 vol % to not greater than 40 vol %.

In yet another embodiment, the body can have an average pore size (D50) of at least 5 microns, or at least 10 microns, or at least 15 microns, or at least 20 microns, or at least 30 microns, or at least 40 microns, or at least 50 microns, or at least 60 microns, or at least 80 microns, or at least 90 microns, or at least 100 microns, or at least 120 microns, or at least 140 microns, or at least 160 microns, or at least 180 microns, or at least 200 microns, or at least 220 microns, or at least 240 microns, or at least 260 microns, or at least 280 microns. In a further embodiment, the average pore size (D50) of the body may be not greater than 300 microns, or not greater than 290 microns, or not greater than 280 microns, or not greater than 270 microns, or not greater than 250 microns, or not greater than 230 microns, or not greater than 210 microns, or not greater than 190 microns, or not greater than 170 microns, or not greater than 150 microns, or not greater than 130 microns, or not greater than 110 microns, or not greater than 90 microns, or not greater than 70 microns, or not greater than 50 microns, or not greater than 30 microns, or not greater than 20 microns. The average pore size (D50) can be a value between any of the minimum and maximum values note above, such as within a range including at least 5 microns to not greater than 300 microns, from at least 20 microns to not greater than 150 microns, or at least 30 microns to not greater than 100 microns.

In another embodiment, the body can have a pore size distribution, wherein the distance between the $10^{th}$ percentile value (D10) of the pore size and the average pore size (D50) may be within a range of at least 3 microns to not greater than 50 microns.

In yet another embodiment, the body can have a pore size distribution, wherein the distance between the $90^{th}$ percentile value (D90) of the pore size and the average pore size (D50) can be within a range of at least 5 microns to not greater than 80 microns.

The coating of the present disclosure can cover the surface of at least a portion of the pores of the body and may not completely fill the pores or close the pore openings, thereby maintaining at least partially an interconnected open pore structure of the body. In a particular aspect, the coating can define a capillary void space extending through at least a portion of the pores.

In one embodiment, the body may include a certain content of open porosity, which can define an interconnected network of pores extending throughout the body and be distinct from closed porosity, which is defined as discrete and isolated pores contained entirely within the body. In embodiments, the body can include at least 5 vol % open porosity for a total volume of the body, such as at least at least 10 vol %, or at least 15 vol %, or at least 20 vol %, or at least 25 vol %, or at least 30 vol %, or at least 35 vol %, or at least 40 vol %, or at least 45 vol %, or at least 50 vol %, or at least 55 vol %, or at least 60 vol %, or at least 65 vol %, or at least 70 vol %, or at least 75 vol %, or at least 80 vol %, or at least 85 vol % open porosity for the total volume of porosity within the bond material. In another embodiment, the open porosity of the body may be not greater than 90 vol %, or not greater than 85 vol %, or not greater than 75 vol %, or not greater than 70 vol %, or not greater than 65 vol %, or not greater than 60 vol %, or not greater than 55 vol %, or not greater than 50 vol %, or not greater than 45 vol %, or not greater than 40 vol %, or not greater than 35 vol %, or not greater than 30 vol %, or not greater than 25 vol %, or not greater than 20 vol %, or not greater than 15 vol %, or not greater than 10 vol %, based on a total volume of the body. The open porosity can be a value between any of the minimum and maximum values noted above, such as within a range including at least 5 vol % to not greater than 90 vol %, or at least 10 vol % to not greater than 80 vol %, or at least 15 vol % to not greater than 45 vol %, or at least 20 vol % to not greater than 40 vol %, based on the total volume of the body.

In an embodiment, a ratio of total porosity to open porosity of the body may be not greater than 1:0.5, such as not greater than 1:0.55, or not greater than 1:0.6, or not greater than 1:0.65, or not greater than 1:0.7, or not greater than 1:0.75, or not greater than 1:0.8, or not greater than 1:0.85, or not greater than 1:0.9, or not greater than 1:0.99.

In a further embodiment, the coating can overly at least 50% of the exterior surface of the body including the pores contained within the body, or at least 60%, or at least 70% or at least 80%, or at least 90%, or at least 95% of the exterior surface of the body. In a particular embodiment, the coating can and may be directly bonded to essentially all of the exterior surfaces of the body of the bonded abrasive article, including the pores extending within the body. In still another embodiment, the coating may be on only the surfaces of the pores contained within the interior volume of the body. For example, the coating may be selectively removed during processing from the exterior surfaces of the body, such that the coating only overlies at least a portion of the pores contained within the body.

In one embodiment, an average thickness of the coating can be at least 0.1 microns, or at least 0.3 microns, or at least 0.5 microns, or at least 1 micron, or at least 2 microns, or at least 3 microns, or at least 5 microns, or at least 7 microns, or at least 10 microns. In another embodiment, an average thickness of the coating may be not greater than 500 microns, or not greater than 300 microns, or not greater than 200 microns, or not greater than 100 microns, or not greater than 75 microns, or not greater than 50 microns, or not greater than 25 microns, or not greater than 10 microns, or not greater than 7 microns, or not greater than 5 microns. The thickness of the coating can be a value between any of the minimum and maximum values noted above, such as within a range including at least 0.1 microns to not greater than 500 microns, at least 1 micron to not greater than 100 microns, or at least from 2 microns to not greater than 20 microns, or at least from 3 microns to not greater than 10 microns.

In yet another embodiment, the coating of the body of the present disclosure can have an average thickness of less than 50% of the average pore diameter or the pores, or less than 45%, or not greater than 40%, or not greater than 35%, or not greater than 30%, or not greater than 25%, or not greater than 20%, or not greater than 15%, or not greater than 10%, or not greater than 8%, or not greater than 5%, or not greater than 2%. In a further embodiment, the average thickness of the coating can be at least 0.1% of the average pore diameter of the pores, or at least 0.5%, or at least 1%, or at least 2%, or at least 3%, or at least 5%, or at least 8%, or at least 10%, or at least 15%, or at least 20%, or at least 25%, or at least 30%. The average thickness of the coating in relation to the average pore diameter of the pores contained within the body can be a value between any of the minimum and maximum values noted above, such as within a range including at least 0.1% to not greater than 49%, or at least 1% to not greater than 30%, or at least 2% to not greater than 25%, or at least 5% to not greater than 20%.

The coating of the present disclosure can include a substituted or unsubstituted poly(p-xylylene) polymer, also called hereafter a parylene. In aspects, the poly(p-xylylene) polymer can be halogenated and include fluorine, chlorine, bromine, or any combination thereof. In further aspects, the poly(p-xylylene) polymer can include alkyl groups or alkoxy groups. In yet further aspects, the poly(p-xylylene) polymer can be a linear polymer, a cross-polymer, or a copolymer. In a particular embodiment, the coating can include a fluorinated poly(p-xylylene).

Figure 2:
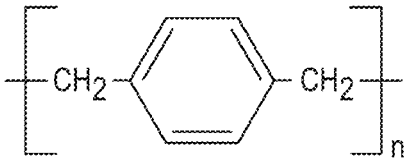
FIG. 2 includes chemical structure formulas of polymer materials included in the coating according to embodiments.
Figure 2:
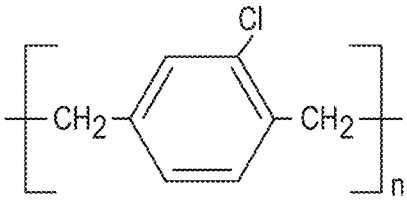
Figure 2:
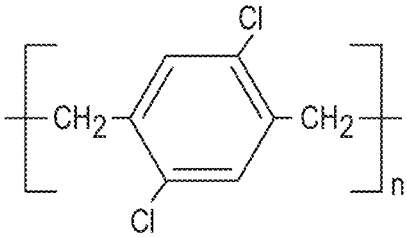
Figure 2:
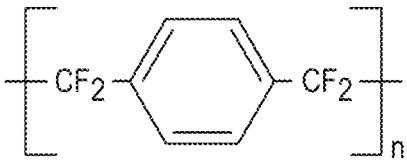

In a specific embodiment, the fluorinated poly(p-xylylene) can have a structure as illustrated in FIG. 2, called parylene HT. In other specific embodiments, as also illustrated in FIG. 2, the poly(p-xylylene) polymer can be chlorinated and have the structure shown for parylene C or parylene D. In another certain embodiment, unsubstituted poly(p-xylylene) may be used for the coating, as shown for structure parylene N in FIG. 2. In a particular embodiment, the coating can consist essentially of parylene HT. In another particular embodiment, the coating can only contain parylene HT except for unavoidable impurities. Unavoidable impurities should be understood as being impurities in an amount not greater than 0.1 vol % based on the total volume of the coating.

In a further embodiment, the coating of the present disclosure can have a melting temperature of at least 250° C., such as at least 270° C., or at least 290° C., or at least 310° C., or at least 330° C., or at least 350° C., or at least 380° C., or at least 400° C., or at least 420° C., or at least 440° C., or at least 460° C., or at least 480° C., or at least 500° C. In another embodiment, the coating can have a melting point not greater than 600° C., or not greater than 580° C., or not greater than 550° C., or not greater than 530° C., or not greater than 510° C., or not greater than 500° C., or not greater than not 460° C., or not greater than 420° C., or not greater than 390° C. The melting temperature of the coating can be a value between any of the minimum and maximum values note above, such as from 250° C. to 600° C., or from 290° C. to 530° C., or from 350° C. to 510° C., or from 380° C. to 500° C.

The bond material of the abrasive article of the present disclosure may have a particular bond chemistry that may facilitate improved manufacturing and performance of the abrasive article of the present disclosure. The bond material can be an inorganic material, an organic material, or a combination thereof.

In one embodiment, the bond material can be an inorganic material, such as a glass, a ceramic, a cermet, a metal, a metal alloy, or any combination thereof. Furthermore, the inorganic material can be an amorphous material, a polycrystalline material, a monocrystalline material or any combination thereof. In a particular embodiment, the bond material can include an oxide, a boride, a nitride, a carbide, or any combination thereof. In a certain particular embodiment, the bond material can consist essentially of an oxide-based vitreous material. In yet another particular embodiment, the bond material can include a metal or metal alloy containing at least one transition metal element. The metal contained in the bond material can be nickel, lead, silver, copper, zinc, tin, titanium, molybdenum, chromium, iron, manganese, cobalt, niobium, tantalum, tungsten, palladium, platinum, gold, ruthenium, or any combination thereof. In a particular embodiment, the bond material can be a glass (vitreous) based system, a glass-ceramic material, or a metal alloy, for example a Cu—Sn—Ti alloy.

In another embodiment, the bond material may be an organic material, such as a natural material, a synthetic material, a polymer, a resin, an epoxy, a thermoset, a thermoplastic, an elastomer, or any combination thereof. In a certain embodiment, the organic material can include a phenolic resin, an epoxy resin, a polyester resin, a polyurethane, a polyester, a polyimide, a polybenzimidazole, an aromatic polyamide, a modified phenolic resin (such as: epoxy modified and rubber modified resin, or phenolic resin blended with plasticizers) or any combination thereof. In a particular embodiment, the organic material contained in the bond material can include a phenolic resin. Exemplary phenolic resins can be Resole or Novolac.

In one embodiment, the content of the bond material contained in the body can be at least 0.5 vol % based on a total volume of the body, such as at least 1 vol %, or at least 5 vol %, or at least 10 vol %, or at least 15 vol %, or at least 20 vol %, or at least 25 vol %, at least 30 vol %, at least 35 vol %, at least 40 vol %, at least 45 vol %, at least 50 vol %, or at least 55 vol %. In another embodiment, the bond material may be not greater than 90 vol % based on a total volume of the body, such as not greater than 85 vol %, or not greater than 80 vol %, or not greater than 75 vol %, or not greater than 70 vol %, or not greater than 65 vol %, or not greater than 60 vol %, or not greater than 55 vol %, or not greater than 50 vol %, or not greater than 40 vol %, or not greater than 35 vol %, or not greater than 30 vol %, or not greater than 25 vol %, or not greater than 20 vol %. The content of the bond material contained in the body can be a value between any of the minimum and maximum values noted above, such as within a range including at least 0.5 vol % to not greater than 90 vol %, or at least 10 vol % to not greater than 70 vol %, or at least 20 vol % to not greater than 60 vol %, or at least 25 vol % to not greater than 75 vol %, or at least 30 vol % to not greater than 55 vol % based on the total volume of the body. In a particular embodiment, the bond material can be at least 10 vol % and not greater than 20 vol % based on the total volume of the body.

The material of the abrasive particles contained in the body can be an oxide, a carbide, a nitride, a boride, an oxynitride, an oxyboride, diamond, or any combination thereof. In a certain aspect, the bond material can include a superabrasive material, for example, diamond or cubic boron nitride. In a particular embodiment, the abrasive particles can consist essentially of diamond having a Vickers hardness of at least about 10 GPa.

In one embodiment, the average particles size of the abrasive particles (D50) can be at least 0.1 microns, or at least 0.5 microns, or at least 1 micron, or at least 2 microns, or at least 5 microns, or at least 8 microns. In another embodiment, the average particle size of the abrasive particles may be not greater than 500 microns, or not greater than 300 microns, or not greater than 200 microns, or not greater than 150 microns, or not greater than 100 microns. The average particles size of the abrasive particles can be a value within any of the minimum and maximum values noted above, such as within a range including at least 0.1 micron to not greater than 500 microns, or at least 10 microns to not greater than 400 microns, or at least 30 microns to not greater than 190 microns.

In yet another embodiment, the content of abrasive particles in the body can be at least 10 vol % for a total volume of the body, or at least 15 vol %, or at least 20 vol %, or at least 25 vol %, or at least 30 vol %, or at least 35 vol %, or at least 40 vol %, or at least 45 vol %, or at least 50 vol %, or at least 55 vol %, or at least 60 vol %, or at least 65 vol %. In another embodiment, the content of abrasive particles in the body may be not greater than 80 vol % abrasive particles based on the total volume of the body, such as not greater than 75 vol %, or not greater than 70 vol %, or not greater than 65 vol %, or not greater than 60 vol %, or not greater than 55 vol %, or not greater than 50 vol %, or not greater than 45 vol %, or not greater than 40 vol %, or not greater than 35 vol %, or not greater than 30 vol %, or not greater than 25 vol %, or not greater than 20 vol %. The content of abrasive particles in the body can be a value between any of the minimum and maximum values note above, such as within a range including at least 10 vol % to not greater than 80 vol %, or at least 20 vol % to not greater than 60 vol %, or at least 30 vol % to not greater than 55 vol %. In a particular embodiment, the content of abrasive particles can be at least 40 vol % and not greater than 50 vol % based on a total volume of the body.

It will be appreciated that the body may have any suitable size and shape as known in the art and can be incorporated into various types of abrasive articles to form a bonded abrasive article. For example, the body can be attached to a substrate, such as a hub of a wheel to facilitate formation of a bonded abrasive grinding wheel.

The body including the coating of the present disclosure can have the advantage that the total porosity of the body, as well as its open porosity, can be to a large content maintained. In one embodiment, a percentage decrease of the total porosity of the body after coating can be not greater than 0.5% based on a total porosity of the body before coating, or not greater than 1%, or not greater than 2%, or not greater than 3%, or not greater 5%, or not greater than 8%, or not greater than 10%, or not greater than 15%, or not greater than 20%, or not greater than 25%, or not greater than 30%, or not greater than 40%, or not greater than 50%. In a certain embodiment, the percentage decrease of the total porosity of the body may be not greater than 20 vol % based on the total porosity of the body before coating.

In another embodiment, the percentage decrease of the open porosity of the body after coating is not greater than 5% based on the open porosity of the body before coating, or not greater than 10%, or not greater than 15%, or not greater than 20%, or not greater than 25%, or not greater than 30%, or not greater than 35%, or not greater than 40%, or not greater than 45%, or not greater than 50%, or not greater than 55%, or not greater than 60%. In a particular embodiment, the percentage decrease of the open porosity may be not greater than 40% based on the open porosity of the body before coating.

Figure 3A:
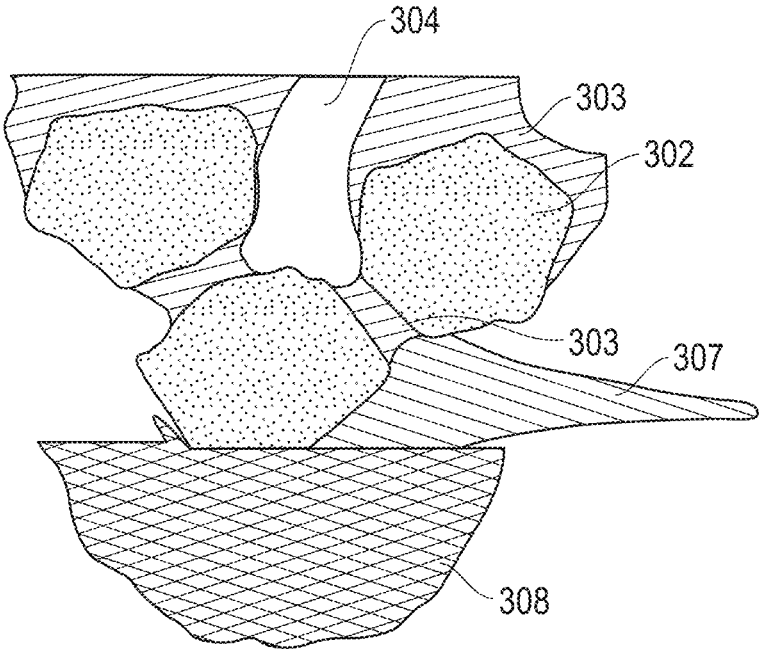
FIG. 3A includes an illustration of a material removal operation using a bonded abrasive article which does not contain a coating.
Figure 3B:
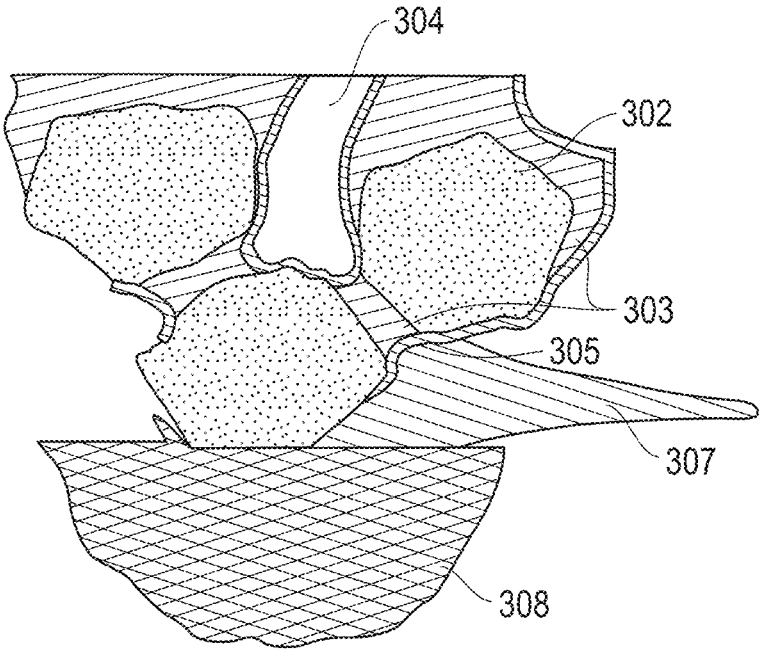
FIG. 3B includes an illustration of a material removal operation using a bonded abrasive article according to one embodiment.

The coating of the body of the present disclosure can provide a good protection of the bond material against corrosion and mechanical destruction. FIGS. 3A and 3B provide an illustration how the coating of the present disclosure can protect the bond material. Both Figures illustrate the polishing of a work piece (308) with a bonded abrasive article including a body comprising a bond material (303), abrasive particles (302) and pores (304). The bonded abrasive article in FIG. 3A does not contain a coating that can protect the bond material, while the bonded abrasive article of FIG. 3B includes a protective coating (305). In FIG. 3A, the bond material (303) can be freely exposed to the cooling fluid (307) during grinding, which can cause enhanced stress, corrosion and cracking of the bond material and may lead to bond failure. As shown in FIG. 1B, a coating (305) contained on the surface of the bond material (303), which corresponds to a large extent with the surface of an interconnected pore structure (304) of the abrasive body, can protect the bond material from the corrosive effect of the coolant (307).

As also described in more detail in the examples, the coating of the body of the present disclosure can enhance the life time of the abrasive article of up to 300%, and can largely increase the amount of treated work parts until a replacement of the dressing is needed. The coating can further increase the flexural strength of the abrasive article of the present disclosure and can provide a good protection against corrosion.

In one aspect, the flexural strength of the body of the abrasive article can have a flexural strength of at least 35 MPa, such as at least 40 MPa, at least 43 MPa, at least 45 MPa, at least 47 MPa, or at least 50 MPa.

In a further aspect, a loss of flexural strength of the body after a corrosion treatment may be not greater than 10%, such as not greater than 8%, not greater than 6%, not greater than 4%, not greater than 3%, or not greater than 2%. Under corrosion treatment should be understood herein a treatment of the body for 24 hours in a water bath at 99° C.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1

A bonded abrasive article comprising:

a body including:

a bond material;

abrasive particles contained within the bond material; and pores contained within the body, wherein at least a portion of the pores have a coating comprising a polymer, wherein the polymer comprises a composition different than the composition of the bond material; and wherein the body comprises a permeability of at least 100 mD.

Embodiment 2

A bonded abrasive article comprising:

a body including:

a bond material;

abrasive particles contained within the bond material; and pores contained within the body, wherein a portion of the pores include a coating comprising a polymer, the portion of pores defining a coated passage, and wherein the coating is disposed between a surface of the bond material and a void space within the portion of pores.

Embodiment 3

A bonded abrasive article comprising:

a body including:

a bond material;

abrasive particles contained within the bond material; and pores contained within the body, wherein a portion of the pores include a coating comprising a polymer, wherein the coating includes an average thickness less than 50% of an average pore diameter of the pores contained within the bond material

Embodiment 4

A bonded abrasive article comprising:

a body including:

a bond material;

abrasive particles contained within the body; and a coating overlying at least a surface of the bond material, wherein the coating comprises a poly(p-xylylene) polymer or a poly(p-xylylene) copolymer.

Embodiment 5

The bonded abrasive article of any one of embodiments 2, 3 and 4, wherein the body comprises a permeability of at least 100 mD.

Embodiment 6

The bonded abrasive article of embodiments 1 or 5, wherein the body comprises a permeability of at least 200 mD, or at least 400 mD, or at least 600 mD, or at least 800 mD, or at least 1000 mD, or at least 1200 mD, or at least 1400 mD, or at least 1600 mD, or at least 1800 mD, or at least 2000 mD, or at least 2200 mD, or at least 2400 mD, or at least 2600 mD, or at least 2800 mD, or at least 3000 mD, or at least 3200 mD, or at least 3400 mD, or at least 3800 mD, or at least 4200 mD, or at least 4600 mD, or at least 5000 mD, or at least 5400 mD, or at least 5800 mD, or at least 6200 mD, or at least 6600 mD, or at least 7000 mD, or at least 7400 mD, or at least 7800 mD, or at least 8200 mD, or at least 9200 mD, or at least 9600 mD, or at least 9800 mD.

Embodiment 7

The bonded abrasive article of embodiments 1 or 5, wherein the body comprises a permeability of not greater than 15,000 mD, or not greater than 12,000 mD, or not greater than 10,000 mD, or not greater than 9800 mD, or not greater than 9600 mD, not greater than 9200 mD, not greater than 8800 mD, not greater than 8400 mD, not greater than 8000 mD, not greater than 7600 mD, not greater than 7200 mD, not greater than 6800 mD, not greater than 6400 mD, not greater than 6000 mD, not greater than 5600 mD, not greater than 5200 mD, not greater than 4800 mD, not greater than 4400 mD, not greater than 4000 mD, not greater than 3600 mD, not greater than 3200 mD, not greater than 2800 mD, not greater than 2400 mD, not greater than 2000 mD, not greater than 2600 mD, not greater than 2200 mD, not greater than 1800 mD, not greater than 1600 mD, or not greater than 1200 mD.

Embodiment 8

The bonded abrasive article of any one of embodiments 1, 2, 3 and 4, wherein the body comprises a porosity of at least 1 vol % for the total volume of the body or at least 2 vol % or at least 5 vol % or at least 8 vol % or at least 10 vol % or at least 15 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol %.

Embodiment 9

The bonded abrasive article of any one of embodiments 1, 2, 3 and 4, wherein the body comprises a porosity of not greater than 85 vol % for the total volume of the body, or not greater than 80 vol %, not greater than 75 vol %, or not greater than 70 vol %, or not greater than 65 vol %, or not greater than 60 vol %, or not greater than 55 vol %, or not greater than 50 vol %, or not greater than 45 vol %, or not greater than 40 vol %, or not greater than 35 vol %, or not greater than 30 vol %, or not greater than 25 vol %, or not greater than 20 vol %, or not greater than 15 vol %, or not greater than 10 vol %, or not greater than 5 vol %, or not greater than 2 vol %.

Embodiment 10

The bonded abrasive article of any one of embodiments 1, 2, 3 and 4, wherein the body comprises an average pore size (D50) of at least 5 microns, or at least 10 microns, or at least 15 microns or at least 20 microns or at least 30 microns or at least 40 microns or at least 50 microns or at least 60 microns or at least 80 microns or at least 90 microns or at least 100 microns, or at least 120 microns, or at least 140 microns, or at least 160 microns, or at least 180 microns, or at least 200 microns, or at least 220 microns, or at least 240 microns, or at least 260 microns, or at least 280 microns.

Embodiment 11

The bonded abrasive article of any one of embodiments 1, 2, 3 and 4, wherein the body comprises an average pore size (D50) of not greater than 300 microns or not greater than 290 microns or not greater than 280 microns, or not greater than 270 microns, or not greater than 250 microns, or not greater than 230 microns, or not greater than 210 microns, or not greater than 190 microns, or not greater than 170 microns, or not greater than 150 microns, or not greater than 130 microns, or not greater than 110 microns, or not greater than 90 microns, or not greater than 70 microns, or not greater than 50 microns, or not greater than 30 microns, or not greater than 20 microns, or not greater than 15 microns.

Embodiment 12

The bonded abrasive article of any one of embodiments 1, 2, 3 and 4, wherein the body comprises a porosity defining a pore size distribution and a distance between a $10^{th}$ percentile value (D10) of the pore size and an average pore size (D50) is within a range of at least 3 microns to not greater than 50 microns.

Embodiment 13

The bonded abrasive article of any one of embodiments 1, 2, 3 and 4, wherein the body comprises a porosity defining a pore size distribution and a distance between a $90^{th}$ percentile value (D90) of the pore size and an average pore size (D50) is within a range of at least 5 microns to not greater than 80 microns.

Embodiment 14

The bonded abrasive article of any one of embodiments 1, 3 and 4, wherein the portion of pores defines a coated passage and the coating is disposed between a surface of the bond material and a void space within the portion of pores.

Embodiment 15

The bonded abrasive article of any one of embodiments 2 and 14, wherein the coating defines a capillary void space extending through the at least portion of the pores.

Embodiment 16

The bonded abrasive article of any one of embodiments 1, 2, 3 and 4, wherein the pores include an open porosity defining an interconnected network of voids extending through the body.

Embodiment 17

The bonded abrasive article of embodiment 16, wherein the body includes at least 5 vol % open porosity for a total volume of the body, or at least 10 vol % or at least 15 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol % or at least 80 vol % or at least 85 vol % or at least 90 vol % or at least 95 vol % or at least 98 vol % open porosity for the total volume of porosity within the body.

Embodiment 18

The bonded abrasive article of embodiment 16, wherein all of the pores within the body are interconnected and define a body comprising entirely open porosity.

Embodiment 19

The bonded abrasive article of embodiment 16, wherein the body comprises an open porosity of not greater than 90 vol % for a total volume of the body, or not greater than 85 vol %, or not greater than 75 vol %, or not greater than 70 vol %, or not greater than 65 vol %, or not greater than 60 vol %, or not greater than 55 vol %, or not greater than 50 vol %, or not greater than 45 vol %, or not greater than 40 vol %, or not greater than 35 vol %, or not greater than 30 vol %, or not greater than 25 vol %, or not greater than 20 vol %, or not greater than 15 vol %, or not greater than 10 vol %, or not greater than 5 vol %, or not greater than 2 vol % open porosity for a total volume of the body.

Embodiment 20

The bonded abrasive article of any one of embodiments 1 to 19, wherein a ratio of total porosity to open porosity of the body is not greater than 1:0.5, or 1:0.55, 1:0.6, or 1:0.65, or 1:0.7, or 1:0.75, or 1:0.8, or 1:0.85, or 1:0.9.

Embodiment 21

The bonded abrasive article of any one of embodiments 1, 2 and 4, wherein the coating has an average thickness of less than 50% of an average pore diameter of the pores contained within the body.

Embodiment 22

The bonded abrasive article of any one of embodiments 3 and 21, wherein the coating comprises an average thickness less than 45% of an average pore diameter of the pores contained within the body, or not greater than 40%, or not greater than 35%, or not greater than 30%, or not greater than 25%, or not greater than 20%, or not greater than 15%, or not greater than 10%, or not greater than 8%, or not greater than 5%, or not greater than 2%.

Embodiment 23

The bonded abrasive article of any one of embodiments 3 and 21, wherein the coating comprises an average thickness of at least 0.1% of the average pore diameter of the pores or at least 0.5%, or at least 1%, or at least 2%, or at least 3%, or at least 5%, or at least 8%, or at least 10%, or at least 15%, or at least 20%, or at least 25%, or at least 30%.

Embodiment 24

The bonded abrasive article of any one of embodiments 1, 2, 3 and 4, wherein the coating comprises an average thickness of at least 0.1 microns, or at least 0.3 microns, or at least 0.5 microns, or at least 1 micron, or at least 2 microns, or at least 3 microns, or at least 5 microns, or at least 10 microns.

Embodiment 25

The bonded abrasive article of any one of embodiments 1, 2, 3 and 4, wherein the coating comprises an average thickness of not greater than 500 microns or not greater than 300 microns or not greater than 200 microns or not greater than 100 microns or not greater than 75 microns or not greater than 50 microns or not greater than 25 microns or not greater than 10 microns or not greater than 5 microns.

Embodiment 26

The bonded abrasive article of any one of embodiments 1, 2 and 3, wherein the coating comprises a poly(p-xylylene) polymer or a poly(p-xylylene) copolymer.

Embodiment 27

The bonded abrasive article of embodiments 4 or 26, wherein the poly(p-xylylene) polymer or the poly(p-xylylene) copolymer include fluorine, chlorine, bromine, or any combination thereof.

Embodiment 28

The bonded abrasive article of any one of embodiments 4, 26, and 27, wherein the poly(p-xylylene) or a poly(p-xylylene) copolymer include an alkyl group or an alkoxy group.

Embodiment 29

The bonded abrasive article of any one of embodiments 4 and 26-28, wherein the poly(p-xylylene) polymer or the poly(p-xylylene) copolymer is a linear polymer or a cross-linked polymer.

Embodiment 30

The bonded abrasive article of any one of embodiments 4 and 26-29, wherein the coating comprises poly(p-xylylene) polymer including fluorine.

Embodiment 31

The bonded abrasive article of embodiment 30, wherein the poly(p-xylylene) polymer includes parylene HT.

Embodiment 32

The bonded abrasive article of any one of embodiments 4 and 26-31, wherein the coating has a melting point of at least 350° C., or at least 380° C., or at least 400° C., or at least 420° C., or at least 440° C., or at least, 460° C., or at least 480° C., or at least 500° C.

Embodiment 33

The bonded abrasive article of any one of embodiments 4 and 26-32, wherein the coating has a melting point of not greater than 600° C., such as not greater than 580° C., not greater than 550° C., not greater than 530° C., not greater than 510° C., not greater than 500° C., or not greater than not 460° C., or not greater than 420° C.

Embodiment 34

The bonded abrasive article of any one of embodiments 1, 2, 3 and 4, wherein the coating is overlying at least 50% of an exterior surface of the body including the pores contained within the body, or at least 60, or at least 70, or at least 80, or at least 90, or at least 95% of the exterior surfaces of the body.

Embodiment 35

The bonded abrasive article of any one of embodiments 1, 2, 3 and 4, wherein the coating overlies and is directly bonded to essentially all of the exterior surfaces of the body of the bonded abrasive including external and internal pore walls extending within the body.

Embodiment 36

The bonded abrasive article of any one of embodiments 1, 2, 3 and 4, wherein the abrasive particles comprises a material selected from the group of materials consisting of oxides, carbides, nitrides, borides, oxynitrides, oxyborides, diamond, or any combination thereof.

Embodiment 37

The bonded abrasive article of any one of embodiments 1, 2, 3 and 4, wherein the abrasive particles comprise a superabrasive material, wherein the abrasive particles comprise diamond, wherein the abrasive particles consist essentially of diamond, wherein the abrasive particles comprise a material having a Vickers hardness of at least about 10 GPa.

Embodiment 38

The bonded abrasive article of any one of embodiments 1, 2, 3 and 4, wherein the abrasive particles include a first type of abrasive particle and a second type of abrasive particle, and wherein the first type of abrasive particle and second type of abrasive particle are different from each other based on at least one particle characteristics selected from the group consisting of hardness, friability, toughness, particle shape, crystalline structure, average particle size, composition, particle coating, grit size distribution, or any combination thereof.

Embodiment 39

The bonded abrasive article of any one of embodiments 1, 2, 3 and 4, wherein the abrasive particles comprise an average particle size of not greater than about 500 microns or not greater than about 300 microns or not greater than about 200 microns or not greater than about 150 microns or not greater than about 100 microns.

Embodiment 40

The bonded abrasive article of any one of embodiments 1, 2, 3 and 4, wherein the abrasive particles comprise an average particle size of at least about 0.1 microns, or at least about 0.5 microns, or at least about 1 micron, or at least about 2 microns, or at least about 5 microns, or at least about 8 microns.

Embodiment 41

The bonded abrasive article of any one of embodiments 1, 2, 3 and 4, wherein the bond material comprises an organic or inorganic material.

Embodiment 42

The bonded abrasive article of embodiment 41, wherein the bond material comprises an inorganic material selected from the group consisting of a glass, a ceramic, a cermet, a metal, a metal alloy, an amorphous material, a polycrystalline material, a monocrystalline material or any combination thereof.

Embodiment 43

The bonded abrasive article of embodiment 42, wherein the bond material comprises a material selected from the group consisting of oxides, borides, nitrides, carbides or any combination thereof.

Embodiment 44

The bonded abrasive article of embodiment 43, wherein the bond material consists essentially of an oxide-based vitreous material.

Embodiment 45

The bonded abrasive article of embodiment 44, wherein the bond material comprises a metal or metal alloy including at least one transition metal element.

Embodiment 46

The bonded abrasive article of embodiment 45, wherein the bond material comprises a metal selected from the group of metals consisting of nickel, lead, silver, copper, zinc, tin, titanium, molybdenum, chromium, iron, manganese, cobalt, niobium, tantalum, tungsten, palladium, platinum, gold, ruthenium or any combination thereof.

Embodiment 47

The bonded abrasive article of any one of embodiments 1, 2, 3 and 4, wherein the bond material comprises an organic material selected from the group consisting of a natural material, a synthetic material, a polymer, a resin, an epoxy, a thermoset, a thermoplastic, an elastomer or any combination thereof.

Embodiment 48

The bonded abrasive article of embodiment 47, wherein the bond material comprises a phenolic resin.

Embodiment 49

A method of forming a bonded abrasive body comprising: coating at least a portion of a body with a coating comprising a polymer, wherein the body comprises a bond material and abrasive particles contained within the bond material, and wherein the polymer comprises a poly(p-xylylene) polymer or a poly(p-xylylene) copolymer.

Embodiment 50

A method of forming a bonded abrasive body comprising: providing a bonded abrasive having a body, the body comprising:

a bond material;

abrasive particles contained within the bond material; and pores contained within the body; and coating at least a portion of surfaces of the pores with a coating comprising a polymer, wherein after coating the bonded abrasive body comprises a permeability of at least 1000 mD.

Embodiment 51

A method of forming a bonded abrasive body comprising: providing a bonded abrasive having a body, the body comprising:

a bond material;

abrasive particles contained within the bond material;

pores contained within the body; and coating at least a portion of the body with a coating comprising a polymer by using a vapor deposition process.

Embodiment 52

The method of any one of embodiments 49, 50, and 51, wherein a percentage decrease in an average total porosity of the body after coating is not greater than 0.5% based on a total porosity of the body before coating, or not greater than 1%, or not greater than 2%, or not greater than 3%, or not greater 5%, or not greater than 8%, or not greater than 10%, or not greater than 15%, or not greater than 20%, or not greater than 25%, or not greater than 30%, or not greater than 40%, or not greater than 50%.

Embodiment 53

The method of any one of embodiments 49 to 52, wherein a percentage decrease in an open porosity of the body after coating is not greater than 5% based on an open porosity of the body before coating, or not greater than 10%, or not greater than 15%, or not greater than 20%, or not greater than 25%, or not greater than 30%, or not greater than 35%, or not greater than 40%, or not greater than 45%, or not greater than 50%, or not greater than 55%, or not greater than 60%.

Embodiment 54

The method of any one of embodiments 49 to 53, wherein the coating comprises a poly(p-xylylene) polymer substituted with fluorine, chlorine, or bromine.

Embodiment 55

The method of any one of embodiments 49 to 54, wherein the coating comprises parylene HT.

Embodiment 56

The method of any one of embodiments 49 to 55, wherein an increase of a flexural strength of the body after coating is at least 2%, such as at least 3%, at least 5%, at least 8%, or at least 10% in comparison to a flexural strength of the body before coating.

Embodiment 57

The bonded abrasive article of any one of embodiments 1 to 48, wherein a loss of flexural strength after a corrosion treatment of the body is not greater than 10%, such as not greater than 8%, not greater than 6%, not greater than 4%, not greater than 3%, or not greater than 2%, the corrosion treatment being an exposure of the body for 24 hours in a water bath having a temperature of 99° C.

Embodiment 58

The bonded abrasive article of any one of embodiments 1 to 48, wherein the body comprises a flexural strength of at least 35 MPa, such as at least 40 MPa, at least 43 MPa, at least 45 MPa, at least 47 MPa, or at least 50 MPa.

EXAMPLES

Example 1

Preparing of grinding wheels coated with Parylene HT.

Three types of grinding wheels (S1, S2, and S3) were formed by mixing together cubic boron nitride (Iljin-950, D50 size 126 microns); fritted-N7-glass (D50 size 12 microns); organic binder (Zusoplast WE8); wax; and water in the amounts as shown in Table 1. The difference between S1 and S2 was the type of wax which was used. While the wax used for S1, S2, and S3 included in all samples a mixture of polyethylene and paraffin type waxes, the wax used for S1 and S3 had a particle size between about 150 to 300 microns, while the wax used for S2 had a smaller particle size of about 40-50 microns.

TABLE 1

| | CBN [g] | N7-glass [g] | Org. Binder [g] | Wax [g] | Water [g] | Vol % CBN | Vol % Vitr. Bond |
|---|---|---|---|---|---|---|---|
| S1 | 74.85 | 18.41 | 7.85 | 8.38 | 10.5 | 41 | 13 |
| S2 | 74.83 | 18.41 | 7.85 | 8.38 | 10.5 | 41 | 13 |
| S3 | 73.37 | 22.22 | 7.36 | 6.77 | 10.29 | 41 | 16 |

After mixing, the mixtures were dried, sieved, pressed into a desired wheel shape, and fired at a temperature of about 600° C. to remove the water, the organic binder and wax. Thereafter, the wheels were sintered at 1000° C. under nitrogen.

The fired wheels were subjected to vapor deposition to apply a thin parylene HT coating under vacuum. The parylene HT vapor deposition process included vaporization of the dimer compound 1,1,2,2,9,9,10,10-octafluoro[2.2] paracyclophane, pyrolysis of the dimer to the monomer, and forming the parylene HT polymer during deposition. The vacuum during deposition in the deposition chamber was 0.1 Torr, at a temperature of 25° C.

Figure 4:
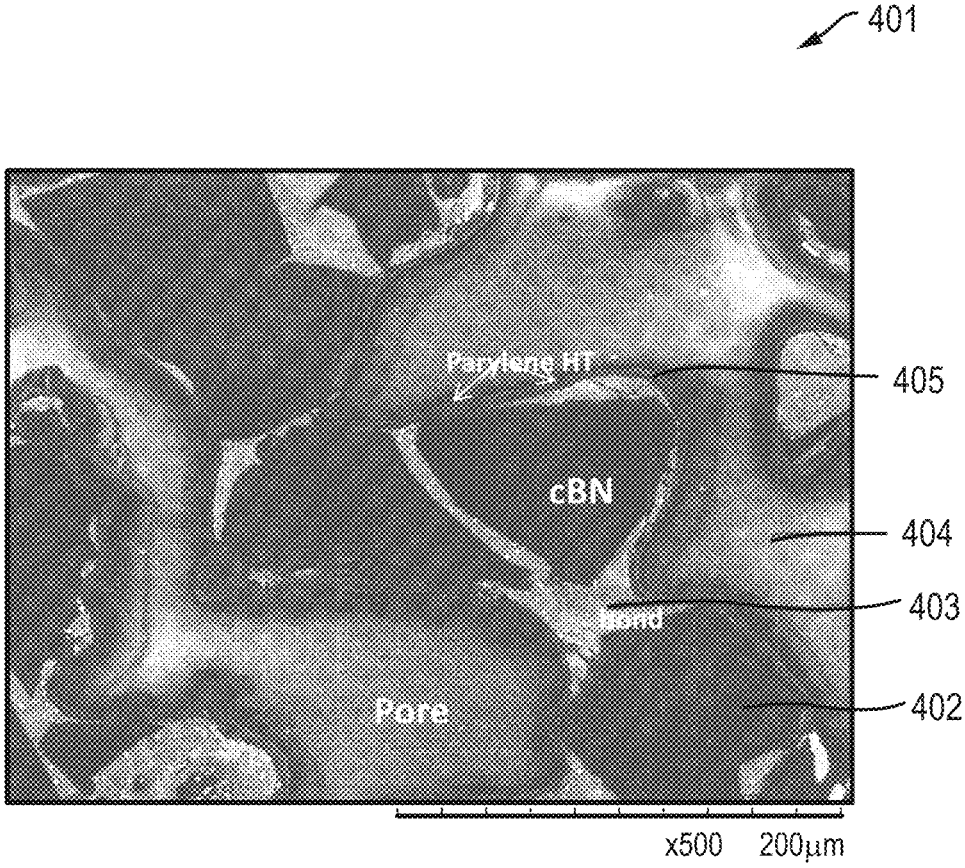
FIG. 4 includes a microscopic image of a cross section of a bonded abrasive body according to one embodiment.

FIG. 4 shows an SEM image of a cross section (401) of a parylene HT coated grinding wheel. It can be seen that a thin coating (405) covers the exterior surface (406) of the pores (404), the pores being voids between the bond material (403) and the abrasive particles (402). The average coating thickness of the parylene HT coating shown in FIG. 4 is between 5 and 7 microns. FIG. 4 also clearly shows that a large interconnected pore structure (407) still exists in the abrasive body after coating, and that the coating did not close the pore openings or filled them up.

The test results of the porosity measurements of grinding wheels S1 and S2 before coating and after coating a 5-7 micron thick parylene HT coating can be seen in Table 2. The porosity measurements were conducted by mercury porosimetry according to ASTM D4404-10. The measured porosity data are described in Table 2 as open porosity, which excludes pore sizes smaller than about 3 nm or isolated larger pores within the body not reachable by the mercury, while the total porosity was calculated based on the theoretical density (calculated density for zero porosity) and the bulk density (MASS/Volume of sample (including open and closed pores). The difference between these two corresponds to the total porosity.

TABLE 2

| | Total Porosity | | | Open Porosity | | |
|---|---|---|---|---|---|---|
| Sample | Before Coating [%] | After Coating [%] | Total Percentage Decrease [%] | Before Coating [%] | After Coating [%] | Total Percentage Decrease [%] |
| S1 | 40.9 | 34.7 | 15.2 | 39.5 | 26.6 | 32.7 |
| S2 | 38.3 | 36.9 | 3.7 | 38.3 | 25.3 | 33.9 |

Figure 5:
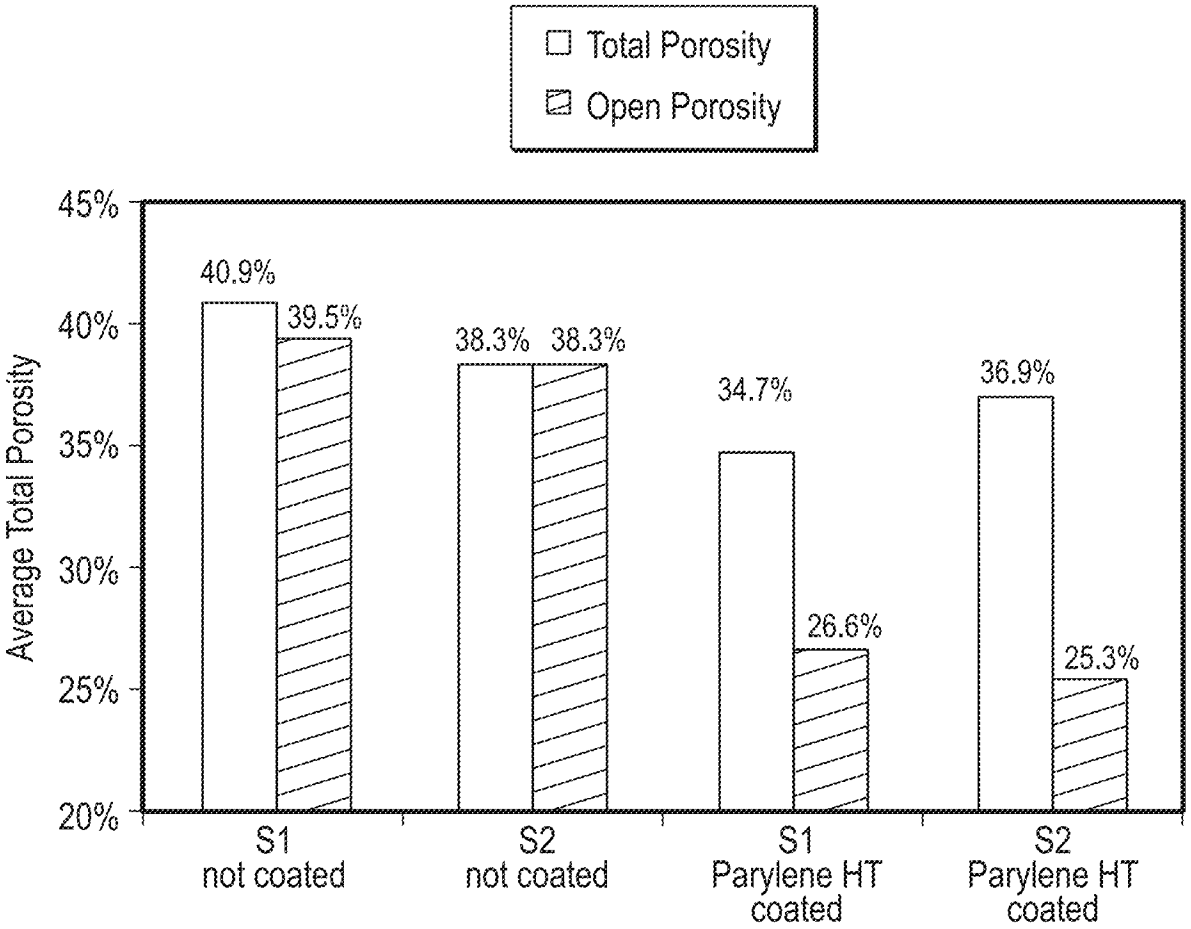
FIG. 5 includes plots illustrating the total porosity and open porosity of conventional bonded abrasive articles and bonded abrasive articles according to the embodiments herein.

The porosity comparisons illustrate that the coating with parylene HT maintains to a large extent the porous structure of the grinding wheels. While there is only a minor difference between total porosity and open porosity in the uncoated samples, the coating with parylene HT reduced the open porosity by about thirty percent, while the total porosity changed only by about 5 to 15 percent. The data shown in Table 2 are further illustrated in FIG. 5.

In sample S1, the ratio of open porosity to total porosity before applying the parylene HT coating was 0.96 and went down to 0.76 after the coating. In sample S2, before the parylene HT coating was applied, all porosity was open porosity, which means the ratio of open porosity to total porosity was 1. After the conducted coating on S2, this ratio lowered to 0.68, which means that still about two thirds of the total porosity is open porosity after applying a parylene HT coating. Accordingly, the data show that a large percentage of the original open porosity could be maintained after applying the parylene HT coating.

Not being bound to theory, it is assumed that the parylene HT coating within the open pore structure of the body can stabilize the abrasive body and thereby making the body more resistance against breakage during grinding operations.

A further comparison of the pore size distribution (D10, D50, and D90 values) throughout the uncoated and coated grinding wheel samples is shown in Table 3. It can be seen that the parylene HT coated samples had a minor decrease in all porosity values, D10, D50, and D90 compared to the corresponding uncoated wheel bodies, and it appears that the decrease in pore size affected all type of pores within the coated wheel bodies.

TABLE 3

| Sample | D50 [microns] | D10 [microns] | D90 [microns] | Δ D10 – D50 [microns] | Δ D50 – D90 [microns] |
|---|---|---|---|---|---|
| S1-uncoated | 68 | 93 | 33 | 25 | 35 |
| S1-coated | 56 | 74 | 27 | 18 | 28 |
| S2-uncoated | 57 | 63 | 40 | 6 | 17 |
| S2 coated | 44 | 52 | 30 | 8 | 14 |

Example 2

Testing of Abrasive Wheel Performance

Figure 9:
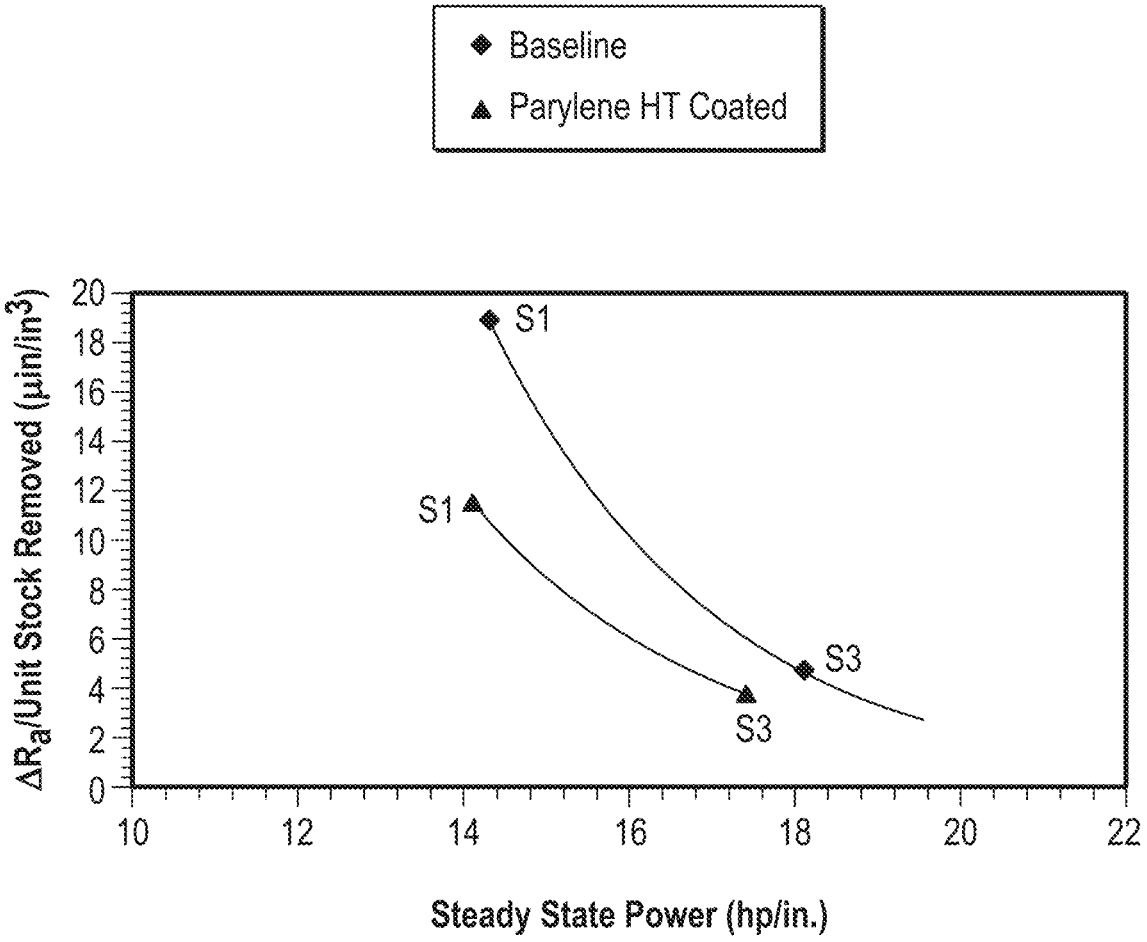
FIG. 9 includes a graph illustrating the grinding performance of conventional bonded abrasive articles and bonded abrasive articles according to the embodiments herein.

The grinding performance of parylene HT coated and uncoated grinding wheels S1 and S3 was compared, as illustrated in FIG. 9. It can be seen that the parylene HT coated grinding wheels were much better in the grinding performance than the corresponding uncoated wheels.

Furthermore, the performance of the parylene HT coated wheels having a metal bond system as bond material was compared with the performance of the respective uncoated grinding wheels. The performance was tested regarding the amount of parts that could be grinded in a water soluble oil until the wheels were not usable anymore, see FIG. 6.

Figure 6:
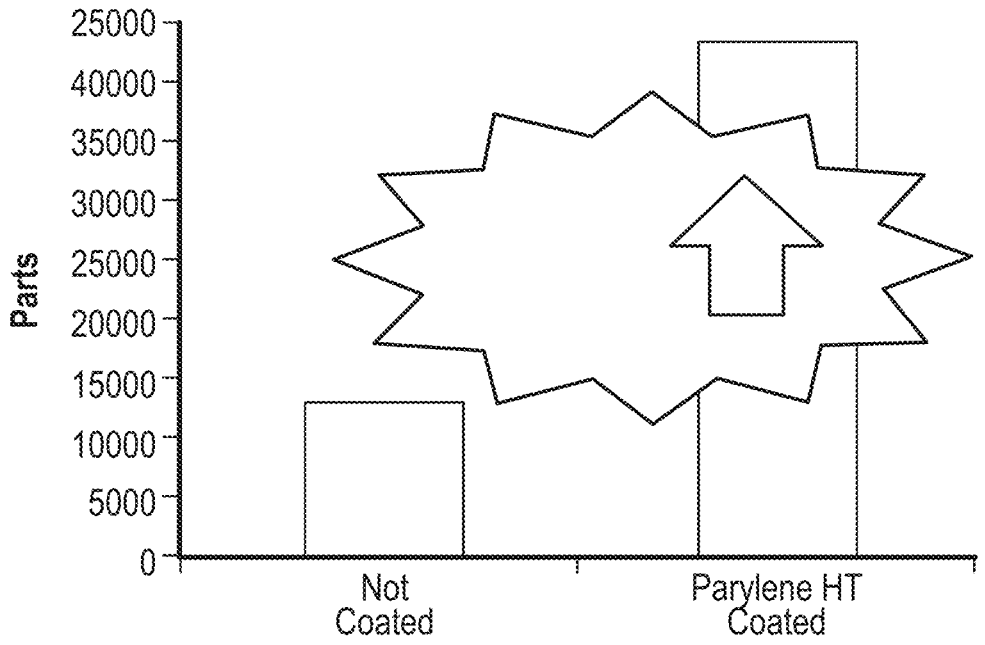
FIG. 6 includes a graph illustrating the work performance of a conventional bonded abrasive article and a bonded abrasive article according to one embodiment herein.

FIG. 6 illustrates that a significant increase in the amount of parts that could be grinded per wheel occurred when the wheel contained a parylene HT coating in comparison to a wheel not subjected to coating with parylene HT. The parylene HT coated grinding wheel had an about three times longer work performance (about 300% more grinded parts) than the same type of grinding wheel not protected by such coating.

Figure 7:
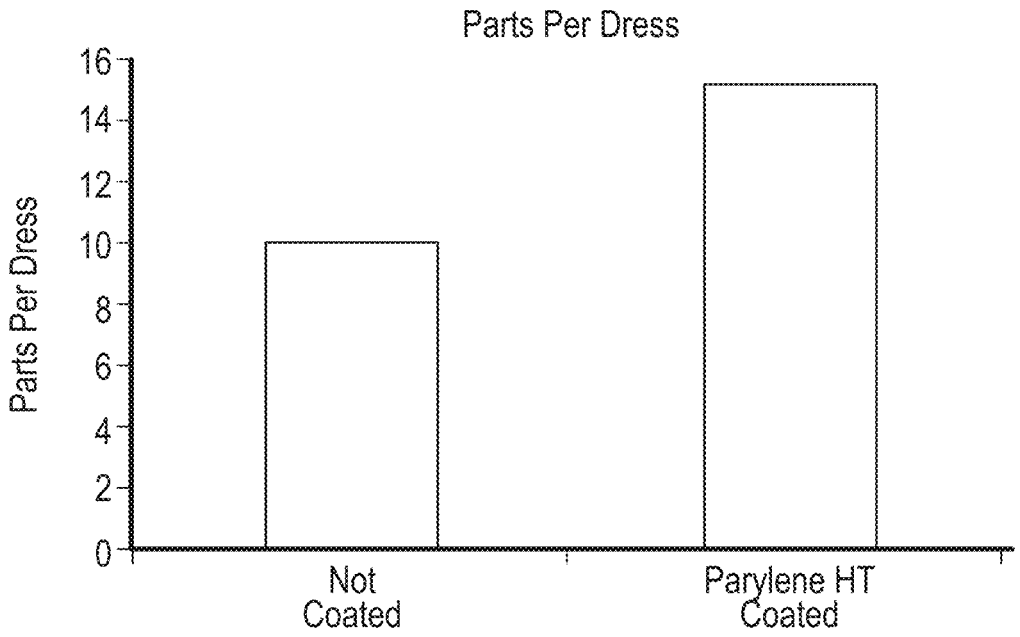
FIG. 7 includes a graph illustrating the amount of parts polished per dressing of a conventional bonded abrasive article and a bonded abrasive article according to one embodiment herein.

It was further observed that the amount of parts that could be used per dressing (until the dressing needed to be renewed) increased significantly when using parylene HT coated grinding wheels by 33% in comparison to uncoated grinding wheels, see FIG. 7.

Example 3

Figure 8:
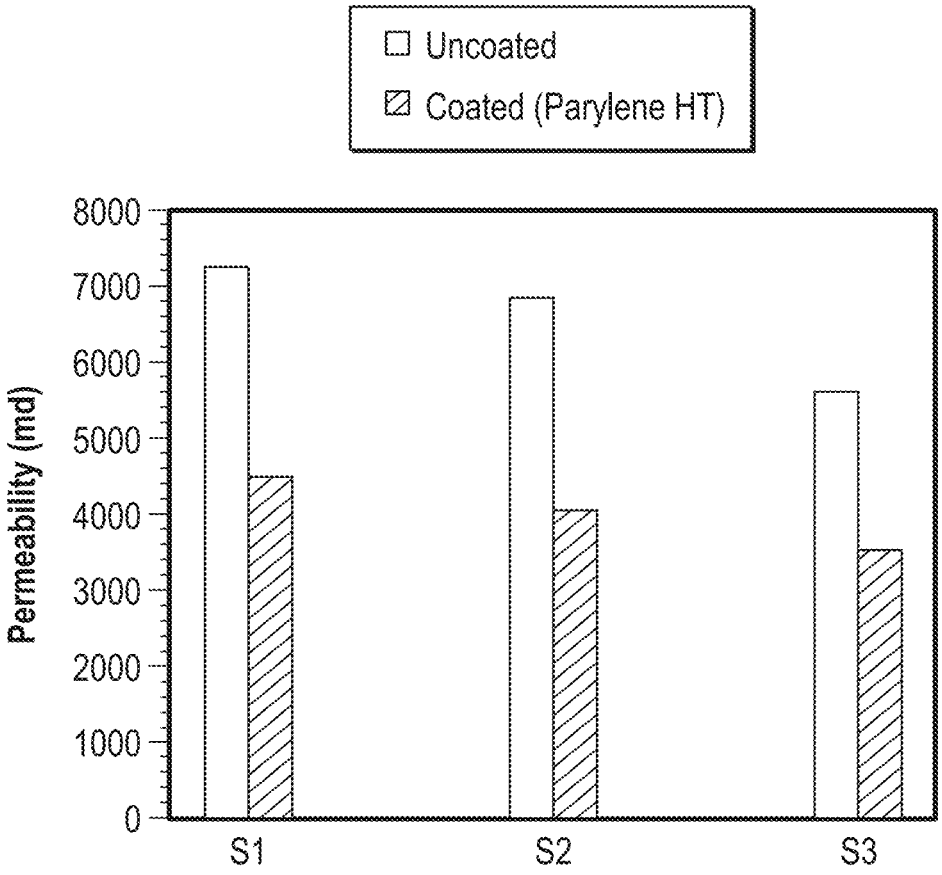
FIG. 8 includes a graph illustrating the permeability of conventional bonded abrasive articles and bonded abrasive articles according to the embodiments herein.

The permeability of uncoated and parylene HT coated grinding wheels S1, S2, and S3, (see Table 1), was tested and compared, as illustrated in FIG. 8.

It can be seen that the parylene HT coating reduced in all samples the permeability by about one third, but the remaining permeability of all samples after coating was still substantial. The decrease in permeability is consistent with the measured reduction in porosity, as shown in Example 2.

The permeability was measured by mercury intrusion porosimetry, using a Micromeritics AutoPore IV mercury porosimeter, which included AutoPore software for calculating the permeability.

All other tested parameters related to the pore structure of the abrasive articles of the present disclosure, such as pore size distribution and open porosity, were measured with the Micromeritics AutoPore IV mercury porosimeter as well.

Example 4

Four types of grinding wheels were prepared using the same ingredients and procedure as described in Example 1, and just the amount of bond (N-7 frit), wax, abrasives (cubic boron nitride) and the porosity was varied. The porosity was adjusted by "pressing to volume," which means that based on the volume of bond and abrasive and the volume of a desired porosity, the volume of the total sample was calculated and the ingredients pressed to that volume. Similar as in Example 1, after the organic binder burnout, wheel samples S4, S5, S6, and S7 were all coated with a 5 to 7 micron thick layer of parylene HT by vapor deposition.

The coated and corresponding uncoated wheels were compared with regard to the flexural strength. Furthermore, the coated and corresponding uncoated wheels were subjected to a corrosion treatment, and the loss of flexural strength after the corrosion treatment was measured. The corrosion treatment required leaving the wheels in a water bath for 24 hours at a water temperature of 99° C.

Figure 10:
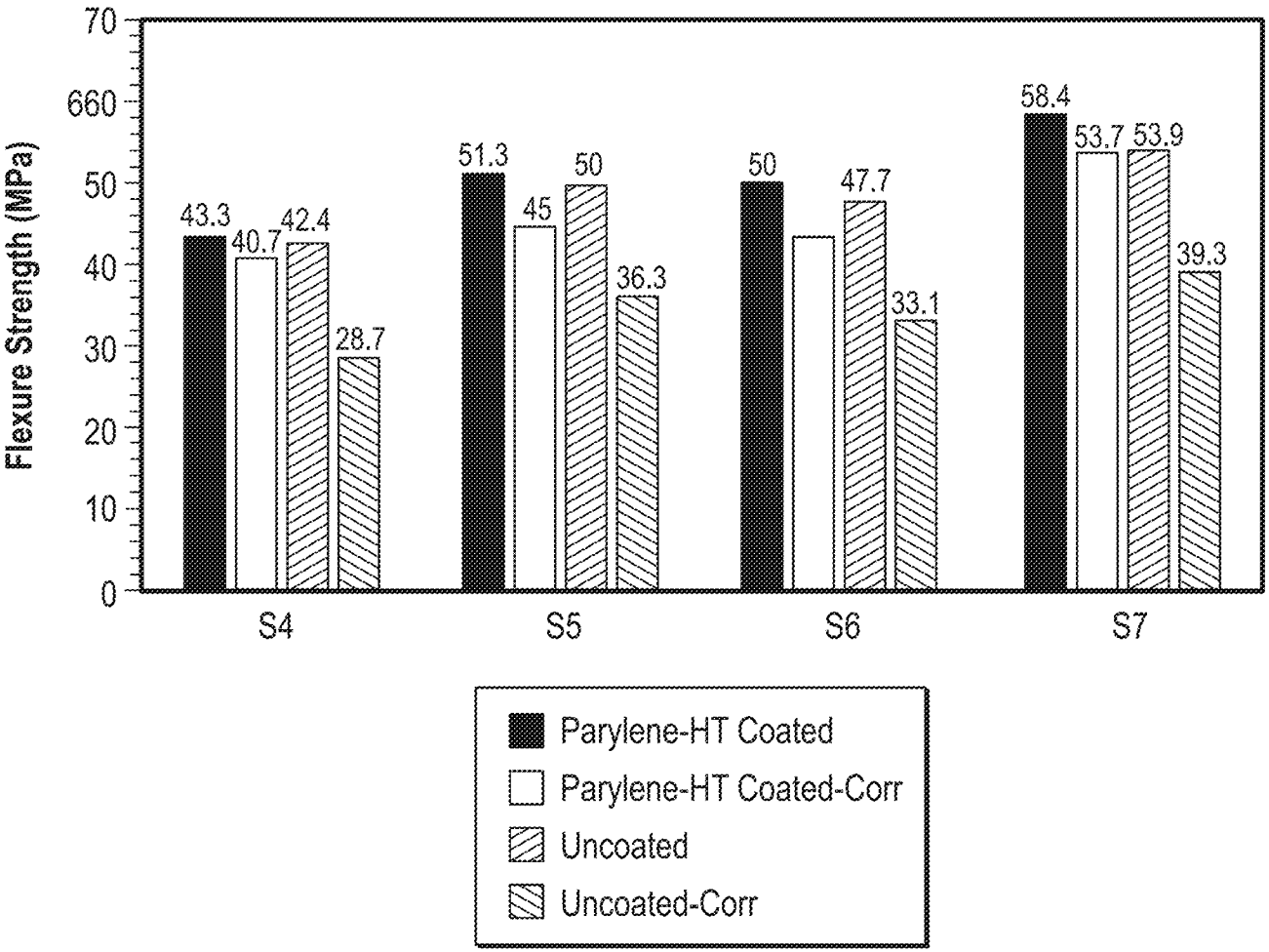
FIG. 10 includes a graph illustrating the flexural strength of conventional bonded abrasive articles and bonded abrasive articles according to embodiments herein, before and after a corrosion treatment.

A summary of the measured flexural strength data can be seen in Table 4 and FIG. 10.

TABLE 4

| Sample | Bond (N-7 glass) [vol %] | CBN [vol %] | Porosity before coating [vol %] | Flexural Strength [Mpa] | | Flexural Strength after corrosion [MPa] | |
|---|---|---|---|---|---|---|---|
| | | | | coated | un-coated | coated | un-coated |
| S4 | 13 | 41 | 46 | 43.3 | 42.4 | 40.7 | 28.7 |
| S5 | 16 | 41 | 43 | 51.3 | 50 | 45 | 36.3 |
| S6 | 13 | 44 | 43 | 50 | 43.3 | 43.3 | 33.1 |
| S7 | 16 | 44 | 40 | 58.4 | 53.9 | 53.7 | 39.3 |

It can be seen that the coated samples always had a higher flexural strength than the corresponding uncoated samples. The experiments further show that while the corrosion treatment caused only a minor loss in flexural strength of the parylene HT coated samples (about −6 to −13%), the loss of flexural strength between uncoated samples before and after corrosion treatment was much higher (about −27 to −32%). The results demonstrate that the applied parylene HT coating increased the flexural strength of the grinding wheels and provided a very good protection against corrosion.

Measurement of the Flexural Strength:

The flexural strength was measured according to a modified ASTM C1161. The ASTM test was modified by using a different sample size, such as rectangular beams with the dimensions: 0.25 inch×0.25 inch×2.625 inch.

Example 5

Grinding wheel samples S4 and S6 described in Example 4 were also tested regarding the average specific grinding power required for grinding a 5 inch diameter disc of 1070 hardened steel (hardened to a Rockwell hardness of between 58-62) at a removal rate of 2 cubic inch/minute in the presence of a dressing. The grinding test was an outer diameter plunge grind test, wherein the core of the wheel was a steel hub of 6 inches diameter and ½ inches thickness. On the outer diameter of the steel hub were glued ½ thick abrasive sections to be tested, such that the total diameter of the testing wheel was 7 inches.

Figure 11:
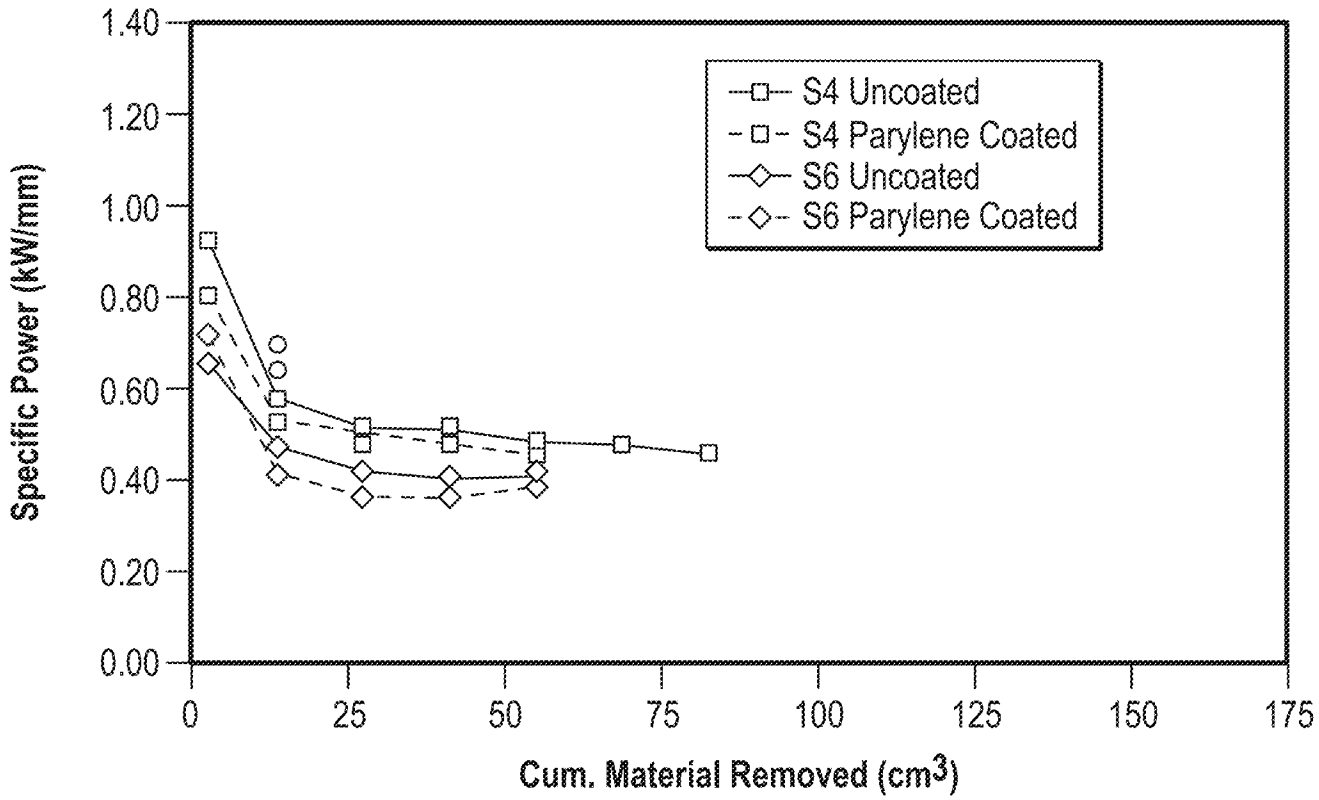
FIG. 11 includes a graph illustrating the specific grinding power during grinding operations of conventional bonded abrasive articles and bonded abrasive articles according to embodiments herein.

As illustrated in FIG. 11, and Table 5, grinding wheel samples S4 and S6 containing a parylene HT coating required a lower average specific grinding power than the corresponding test samples not coated with parylene HT.

TABLE 5

| Sample | % reduction of average specific grinding power |
|---|---|
| S4 | −1% |
| S6 | −6% |

The foregoing embodiments are directed to bonded abrasive products, and particularly grinding wheels, which represent a departure from the state-of-the-art.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Reference herein to a material including one or more components may be interpreted to include at least one embodiment wherein the material consists essentially of the one or more components identified. The term "consisting essentially" will be interpreted to include a composition including those materials identified and excluding all other materials except in minority contents (e.g., impurity contents), which do not significantly alter the properties of the material. Additionally, or in the alternative, in certain non-limiting embodiments, any of the compositions identified herein may be essentially free of materials that are not expressly disclosed. The embodiments herein include range of contents for certain components within a material, and it will be appreciated that the contents of the components within a given material total 100%.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A bonded abrasive article comprising:

a body including:

a bond material;

abrasive particles contained within the bond material; and pores contained within the body, wherein at least a portion of the pores have a coating comprising a polymer, wherein the polymer comprises a composition different than the composition of the bond material; and wherein the body comprises a permeability of at least 100 mD, and the body comprises an average pore size (D50) of at least 5 microns and not greater than 300 microns.

2. The bonded abrasive article of claim 1, wherein the coating comprises a poly(p-xylylene) polymer including fluorine.

3. The bonded abrasive article of claim 2, wherein the coating comprises parylene HT.

4. The bonded abrasive article of claim 1, wherein the body comprises a permeability of at least 800 mD and not greater than 15,000 mD.

5. The bonded abrasive article of claim 1, wherein the pores comprise an open porosity defining an interconnected network of voids extending through the body, and wherein the open porosity is at least 5 vol % and not greater than 90 vol % based on a total volume of the body.

6. The bonded abrasive article of claim 1, wherein a ratio of total porosity to open porosity of the body is not greater than 1:0.5.

7. The bonded abrasive article of claim 1, wherein an average thickness of the coating is less than 50% of an average pore diameter of the pores contained within the body.

8. The bonded abrasive article of claim 1, wherein the coating comprises an average thickness of at least 0.5 microns and not greater than 10 microns.

9. The bonded abrasive article of claim 1, wherein the coating has a melting point of at least 350° C. and not greater than 600° C.

10. The bonded abrasive article of claim 1, wherein the coating is overlying at least 50% of an exterior surface of the body including the pores contained within the body.

11. The bonded abrasive article of claim 1, wherein the abrasive particles comprise a material selected from oxides, carbides, nitrides, borides, oxynitrides, oxyborides, diamond, or any combination thereof.

12. The bonded abrasive article of claim 1, wherein the abrasive particles comprise an average particle size of at least 0.1 microns and not greater than about 500 microns.

13. The bonded abrasive article of claim 1, wherein the bond material comprises an oxide-based vitreous material.

14. The bonded abrasive article of claim 1, wherein the body comprises a flexural strength of at least 35 MPa.

15. The bonded abrasive article of claim 1, wherein a loss of flexural strength of the body after a corrosion treatment is not greater than 10%, the corrosion treatment being an exposure of the body for 24 hours in a water bath having a temperature of 99° C.

16. A method of forming a bonded abrasive body comprising:

providing a bonded abrasive having a body, the body comprising:

a bond material;

abrasive particles contained within the bond material;

pores contained within the body; and coating at least a portion of the body with a coating comprising a poly(p-xylylene) polymer by conducting a vapor deposition process, wherein the permeability of the body after coating is at least 100 mD, and a ratio of total porosity to open porosity of the body after coating is not greater than 1:0.5.

17. The method of claim 16, wherein the coating comprises parylene HT.

18. The method of claim 16, wherein an increase of a flexural strength of the body after coating is at least 5% in comparison to a flexural strength of the body before coating.

19. The bonded abrasive article of claim 1, wherein the coating comprises parylene HT, the bond material comprises an oxide-based vitreous material, and the permeability of the body is at least 800 mD.

20. A bonded abrasive article comprising:

a body including:

a bond material;

abrasive particles contained within the bond material; and pores contained within the body, wherein at least a portion of the pores have a coating comprising a polymer, wherein the polymer comprises a composition different than the composition of the bond material; and wherein the body comprises a permeability of at least 100 mD, and the coating comprises an average thickness of at least 0.5 microns and not greater than 10 microns.

21. The bonded abrasive article of claim 20, wherein the coating comprises a poly(p-xylylene) polymer including fluorine.

22. The bonded abrasive article of claim 21, wherein the coating comprises parylene HT.

23. The bonded abrasive article of claim 20, wherein the pores comprise an open porosity defining an interconnected network of voids extending through the body, and wherein the open porosity is at least 5 vol % and not greater than 90 vol % based on a total volume of the body.

24. The bonded abrasive article of claim 20, wherein a ratio of total porosity to open porosity of the body is not greater than 1:0.5.

25. The bonded abrasive article of claim 20, wherein an average thickness of the coating is less than 50% of an average pore diameter of the pores contained within the body.

26. The bonded abrasive article of claim 20, wherein the coating has a melting point of at least 350° C. and not greater than 600° C.

27. The bonded abrasive article of claim 20, wherein the coating is overlying at least 50% of an exterior surface of the body including the pores contained within the body.

28. The bonded abrasive article of claim 20, wherein the abrasive particles comprise a material selected from oxides, carbides, nitrides, borides, oxynitrides, oxyborides, diamond, or any combination thereof.

29. The bonded abrasive article of claim 20, wherein the abrasive particles comprise an average particle size of at least 0.1 microns and not greater than about 500 microns.

30. The bonded abrasive article of claim 20, wherein the bond material comprises an oxide-based vitreous material.

31. The bonded abrasive article of claim 20, wherein the coating comprises parylene HT, the bond material comprises an oxide-based vitreous material, and the permeability of the body is at least 800 mD.

32. The bonded abrasive article of claim 20, wherein the body comprises a flexural strength of at least 35 MPa.

33. The bonded abrasive article of claim 20, wherein a loss of flexural strength of the body after a corrosion treatment is not greater than 10%, the corrosion treatment being an exposure of the body for 24 hours in a water bath having a temperature of 99° C.

* * * * *